US012173997B1

(12) United States Patent
Speirs et al.

(10) Patent No.: US 12,173,997 B1
(45) Date of Patent: Dec. 24, 2024

(54) VARIABLE DIAMETER CONICAL NOSE

(71) Applicant: The United States of America as represented by the Secretary of the Navy, Newport, RI (US)

(72) Inventors: Nathan B Speirs, Provo, UT (US); David E Yamartino, Riverside, RI (US); Aren M Hellum, Wakefield, RI (US); Jesse L Belden, Dighton, MA (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 18/233,427

(22) Filed: Aug. 14, 2023

(51) Int. Cl.
*F16H 1/12* (2006.01)
*F42B 19/00* (2006.01)
*F42B 19/12* (2006.01)

(52) U.S. Cl.
CPC ..... *F42B 19/125* (2013.01); *F42B 19/005* (2013.01)

(58) Field of Classification Search
CPC ..... F42B 19/125; F42B 19/005; F42B 10/52; F16H 1/12
USPC ..... 74/422
See application file for complete search history.

(56) References Cited

U.S. PATENT DOCUMENTS 3,041,992 A * 7/1962 Lee ..... B63G 8/00 114/67 R
3,494,284 A * 2/1970 Gross ..... F42B 12/204 102/491
4,449,211 A * 5/1984 Schmidt ..... G10K 11/008 367/172
4,579,298 A * 4/1986 Thomson ..... F42B 19/005 244/3.21
4,674,706 A * 6/1987 Hall ..... F42B 10/44 102/489
4,989,530 A * 2/1991 Thompson, Jr. ..... F42B 19/01 114/21.3
5,186,117 A * 2/1993 Stallard, III ..... B63G 8/20 114/144 R
6,364,248 B1 * 4/2002 Spate ..... F42B 10/62 244/3.21
6,485,106 B1 * 11/2002 Hermansen ..... B05B 12/29 301/37.104
7,428,870 B1 * 9/2008 Nedderman ..... F42B 19/005 114/21.1
8,093,487 B2 * 1/2012 Kimerer, Jr. ..... F42B 19/005 102/390
8,256,086 B2 * 9/2012 Shutler ..... F42B 10/46 73/167
8,418,642 B2 * 4/2013 Vosburgh ..... F42B 12/365 114/328

(Continued)

*Primary Examiner* — Ha Dinh Ho
(74) *Attorney, Agent, or Firm* — James M. Kasischke; Michael P. Stanley; Jeffry C. Severson

(57) ABSTRACT

A variable diameter conical nose is provided. The conical nose includes a cone formed from a circular sheet of ductile material having a sector removed. The formed cone has a first overlapping portion and a second overlapping portion overlying the first overlapping portion. The first overlapping portion is fixed and the second overlapping portion is free to move. The conical nose includes an actuator capable of varying the diameter of the cone by moving the second overlapping portion relative to the first overlapping portion.

4 Claims, 7 Drawing Sheets

(56) References Cited

U.S. PATENT DOCUMENTS

| | | | | |
|---|---|---|---|---|
| 8,487,227 | B2 * | 7/2013 | Rastegar | F42B 10/44<br>102/490 |
| 8,720,091 | B1 * | 5/2014 | Snyder | G09F 15/02<br>40/607.01 |

* cited by examiner

- PRIOR ART -

VARIABLE DIAMETER CONICAL NOSE

STATEMENT OF GOVERNMENT INTEREST

The invention described herein was made in the performance of official duties by employees of the U.S. Department of the Navy and may be manufactured, used, or licensed by or for the Government of the United States for any governmental purpose without payment of any royalties thereon.

BACKGROUND OF THE INVENTION

1) Field of the Invention

The present invention is directed to a variable diameter, cone-shaped nose for a traveling body whose base radius is controllable.

2) Description of the Prior Art

A body for traveling from air into water to form an underwater gas cavity; typically has a conical nose on a leading edge of the body. The lift and drag of the nose as well as the cavity-producing properties of the nose are well understood.

The drag of a conical nose increases with the base diameter of the cone. For a cavity-producing cone, the lift coefficient is a function of a half angle "B" of the nose and an attack angle "α". For β=45°, the lift coefficient is flat with changes in α; that is, the cone does not produce lift.

If the conical nose produces a gas cavity; the cavity can be modeled as an ellipse with a cavity diameter "$D_c$" and a cavity length "$L_c$". The diameter $D_c$ and length $L_c$ are in a cavitation range and Froude numbers are determinable in Equation (1) and Equation (2):

$$D_C = \frac{d_{c,eff}}{\sqrt{\sigma}} \tag{1}$$

$$L_C = d_{c,eff}\frac{\sqrt{-(1+\sigma)\ln\sigma}}{\sigma}. \tag{2}$$

The effective cavitator diameter $d_{c,eff}$ is a drag-corrected cavitator diameter, such that in Equation (3)

$$d_{c,eff} = d_c\sqrt{\frac{C_{D0,c}}{C_{D0,disk}}}. \tag{3}$$

The drag coefficients $C_{D0,c}$ and $C_{D0,disk}$ are the σ=0 drag coefficients of the cavitator and a disk cavitator. The shape of the cavitator enters the cavity sizing by the use of Equation (3). The cavitation number σ is the primary determinant of the cavity diameter and length, and is defined by Equation (4) as $$\sigma = \frac{p_\infty - p_c}{\frac{1}{2}\rho U(t)^2}. \tag{4}$$

The local pressure $p_\infty = p_{atm} - \mu g z(t)$ is dependent on the depth "z(t)" and the fluid density "ρ". Fluid density is the main reason that saltwater impact is quantitatively different from impact in fresh water; however, the physics are not substantially different. The cavity pressure $p_c \geq p_v$ where $p_v$ is the temperature/medium dependent vapor pressure of the surrounding liquid. If non-condensable gas exists in the cavity then $p_c > p_v$. An impact from air into water typically entrains air into the cavity to result in $p_c > p_v$.

Thus, higher speed will result in a larger cavity diameter "$D_c$". If the goal upon the water entry of a body is to have the cavity envelope the body while sustaining minimum drag; then the cone base diameter should be minimized for a given impact speed "$U_o$". However, as the body travels underwater, the speed of the body is likely to decrease and thus the cavity diameter will also decrease.

To continue enveloping the body in a cavity; a larger cone base diameter is required. For a static cone nose; a larger diameter may result in additional drag on the body. By varying the cone diameter, the size of the cavity can align to the body shape for a given value of the time-varying body speed. Furthermore, variable lift characteristics may be needed at the nose. These applications include a need to turn or stabilize a body. Changing the half angle β of the cone allows for variation in a lift coefficient.

As such, there is a need for a variable diameter cone-shaped nose in which a base radius may be actively or passively controlled. There is also a need for a conical nose with variable geometric properties to control drag, lift, and cavity-producing properties.

SUMMARY OF THE INVENTION

The present disclosure describes a variable diameter cone-shaped nose with a base radius that can be actively or passively controlled to influence the dynamics of an underwater body or a body penetrating the water from air.

The geometric properties of a conical nose affect the drag and lift on a body, as well as the characteristics of a gas cavity that surrounds the body. The latter as a strong function of speed, and different cone geometries may be desired for different speeds. For applications in which the body speed is expected to vary significantly over the transit duration, it is desirable to change the cone geometry.

The variable diameter conical nose includes a cone having a first overlapping portion and a second overlapping portion overlying the first overlapping portion. An actuator varies the diameter of the cone by moving one of the first overlapping portion and the second overlapping portion relative to the other overlapping portion.

In another embodiment of the invention, an apparatus includes a cone formed from a circular sheet of ductile material with a removed sector. The cone has a first overlapping portion and a second overlapping portion overlying the first overlapping portion. The first overlapping portion is fixed and the second overlapping portion is free to move. An actuator is capable of changing the diameter of the cone by moving the second overlapping portion relative to the first overlapping portion.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
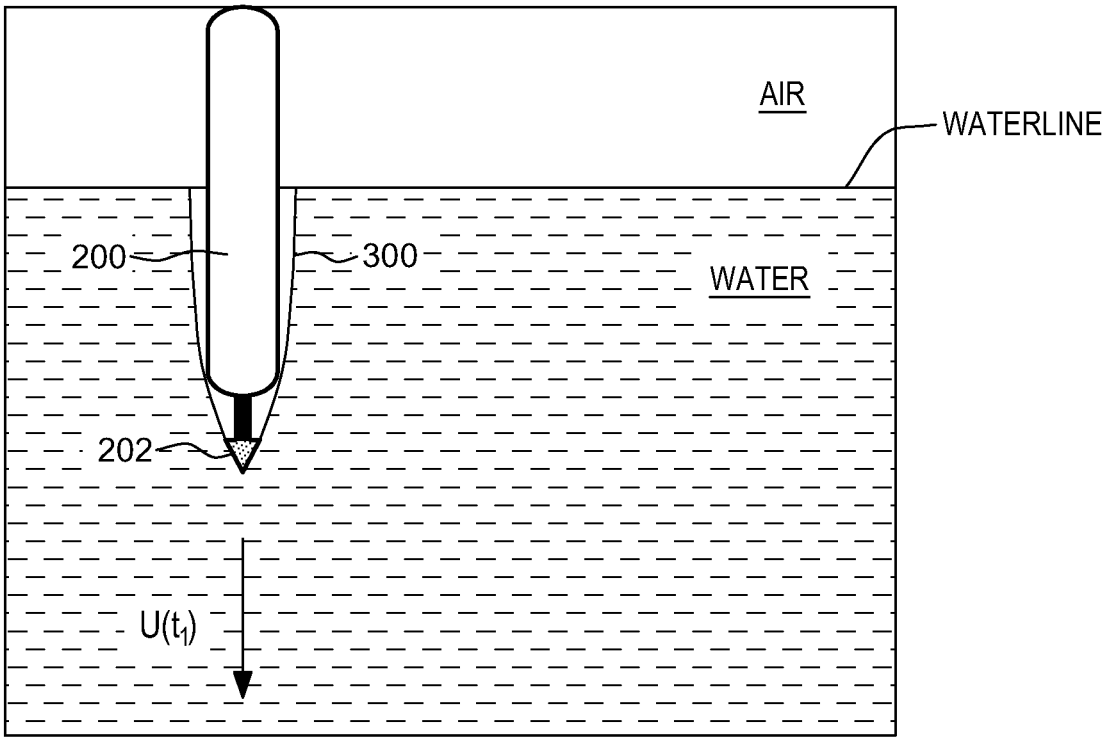
FIG. 1 PRIOR ART
FIG. 1 is a prior art side view of water entry by a body with a conical nose.
Figure 2:
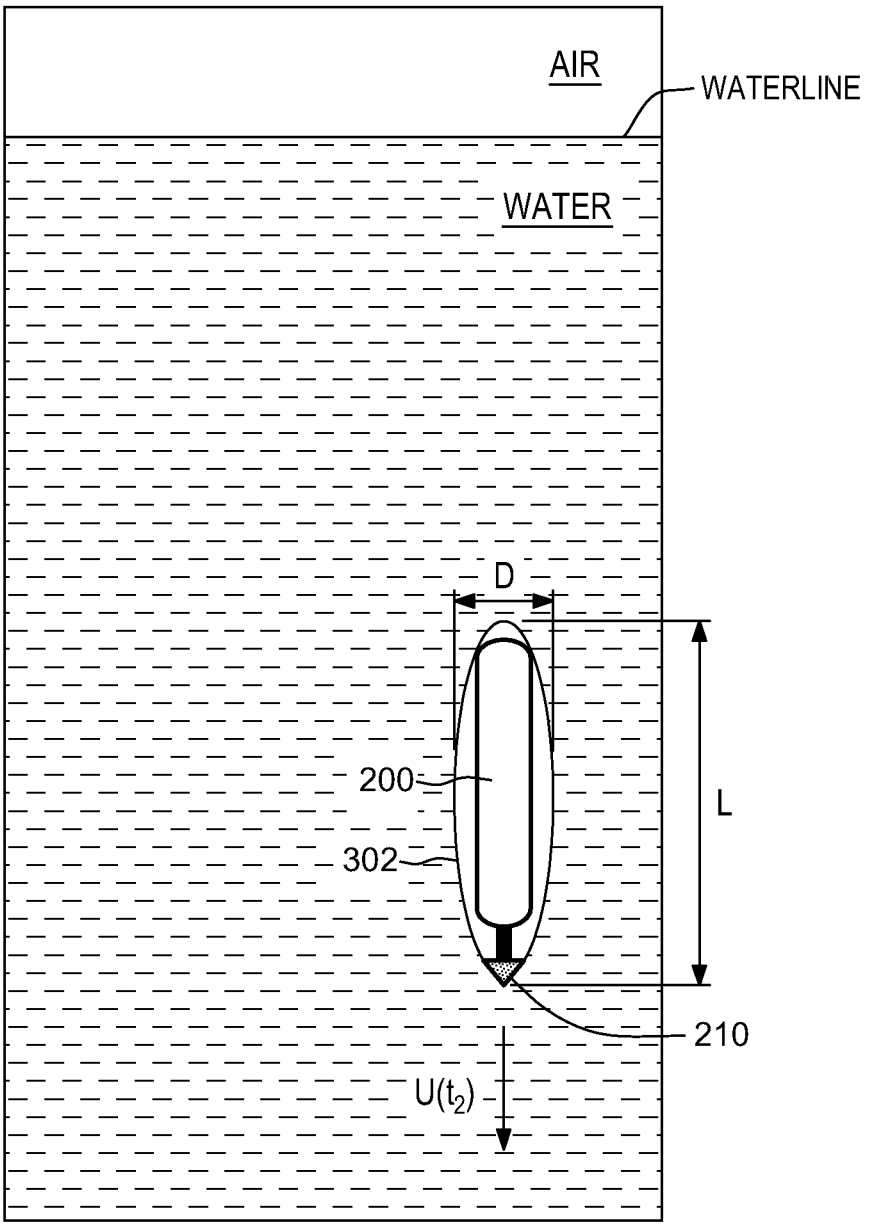
FIG. 2 is a prior art side view of the body of FIG. 1 enveloped by an elliptical cavity when underwater.

FIG. 1 depicts a prior art water entry of a body 200 with a conical nose 202. The conical nose 202 forms a cavity 300 upon entry where the cavity begins to envelope the body 200. As shown in FIG. 2, when the body 200 is below a waterline; an elliptical cavity 302 of a cavity diameter "D" and cavity length "L" envelopes the body. If $U(t_2)<U(t_1)$, as shown in both figures, then a larger diameter conical nose 210 is required to envelope the body 200.

Figure 3:
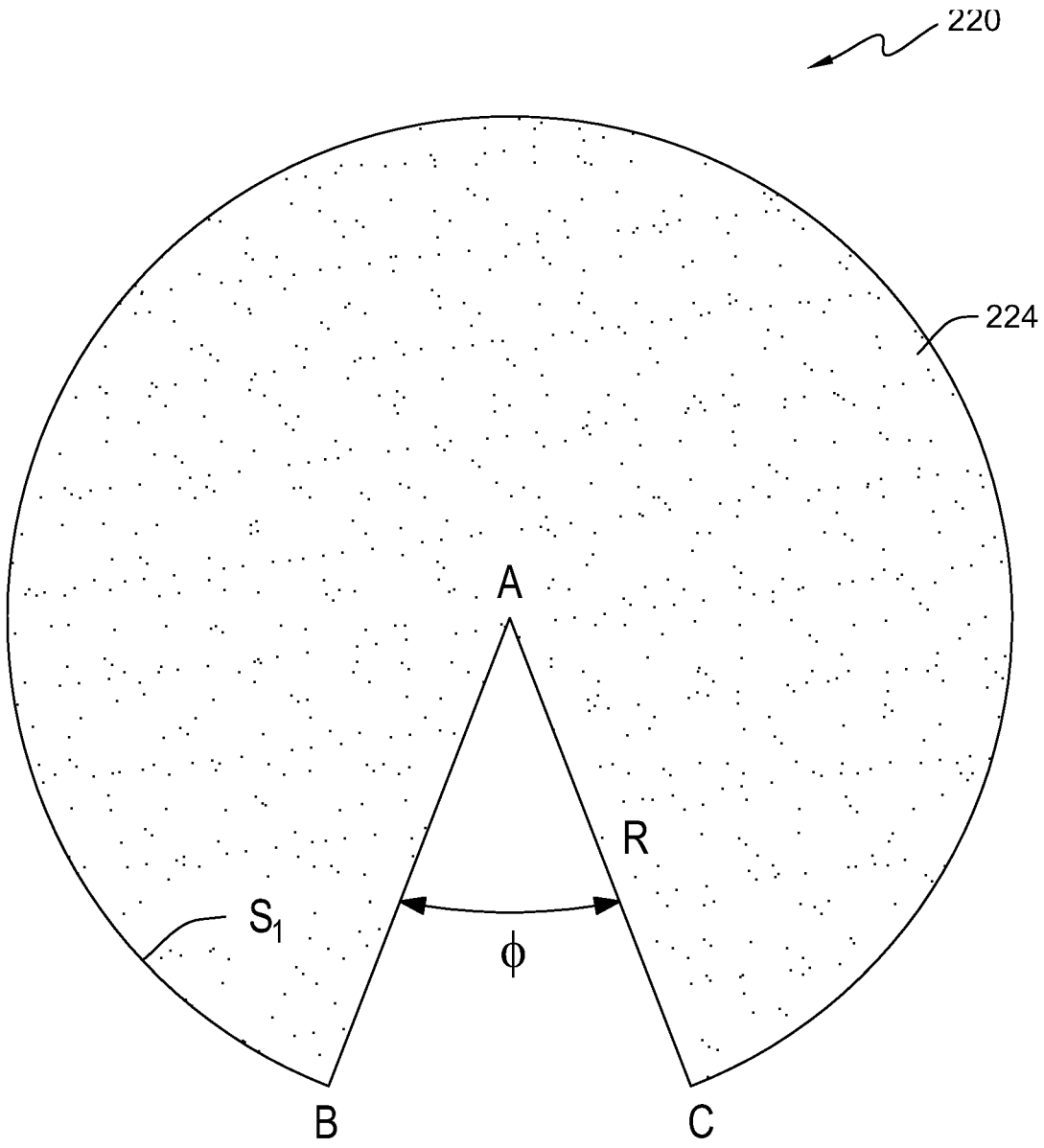
FIG. 3 depicts a sheet of ductile material for forming a cone.

The invention is a conical nose design with variable geometric properties to enable control of drag, lift and cavity-producing properties. Referring to FIG. 3, a flat sheet 220 of ductile material can be cut into a circle 224 with a radius "R". A rounded slice spanning an angle $\phi$ is removed from the circle 224; thereby, leaving the arc length, $S_1=R(2\pi-\phi)$.

Figure 4:
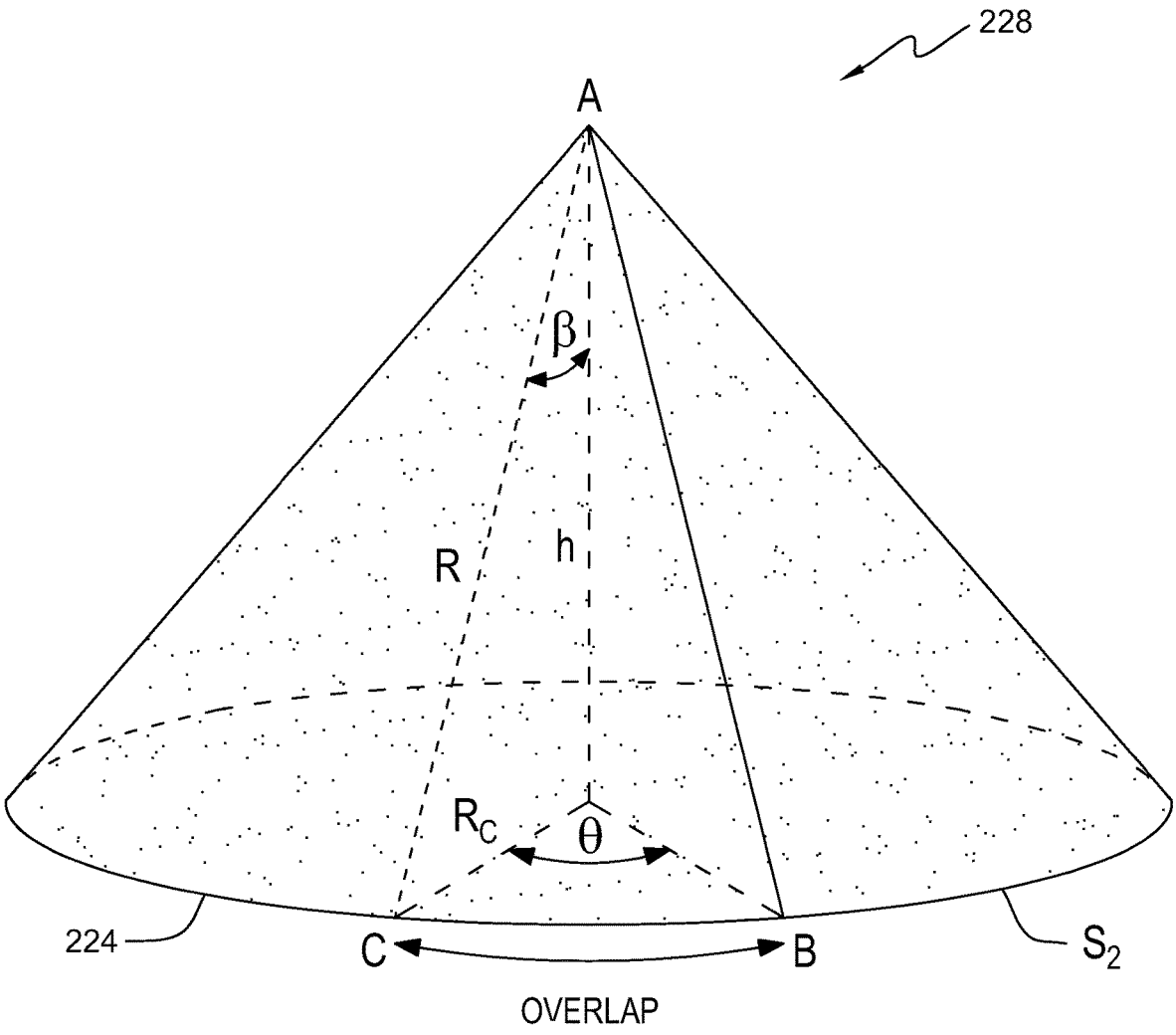
FIG. 4 depicts a cone formed by the sheet of ductile material.

As shown in FIG. 4, the sheet 220 is formed into a cone 228 where the center of the circle 224 becomes a vertex "A". The edges AB and AC overlap with the amount of overlap characterized by an angle "$\theta$", and the geometric properties of interest are the base radius "$R_c$" of the cone, the height "h" of the cone and the half-angle "$\beta$". These properties can be derived by the known parameters R and $\phi$.

The circumference of the base of the cone 228 is $S_2=2\pi R_c=R(2\pi-\phi)$. The circumference can be solved to provide the base radius of the cone 228 by Equation (5)

$$\frac{R_c}{R}=\frac{2\pi-\phi}{2\pi+\theta}. \tag{5}$$

The half angle of the cone 228 is then provided by Equation (6)

$$\beta=\sin^{-1}\left(\frac{R_c}{R}\right)=\sin^{-1}\left(\frac{2\pi-\phi}{2\pi+\theta}\right) \tag{6}$$

and the cone height is provided by Equation (7)

$$\frac{h}{R}=\sqrt{1-\sin^2\beta} \tag{7}$$

Thus, the geometry of the cone 228 is defined by the initial geometry of the sheet 300 (defined by R, $\phi$) and the overlap $\theta$. Changing the overlap $\theta$ allows for control over the geometry of the cone 228. That is, the cone 228 can be formed with maximum overlap $\theta$ to make a tall cone with a small base diameter. Alternatively, the cone 228 can be formed with minimum overlap $\theta$ to make a short cone with a large base diameter.

Equations (5), (6) and (7) are non-dimensional and can define attainable cone geometries for chosen combinations of $\theta$ and $\phi$ and for arbitrary values of R. These parameters can be mapped into existing models for drag, lift, and cavity-forming properties to generate control logic that couples the cone geometry to the physics. In order to control the cone geometry (and thus alter the physical state cone-body system) requires actuation of the overlap $\theta$.

Figure 5:
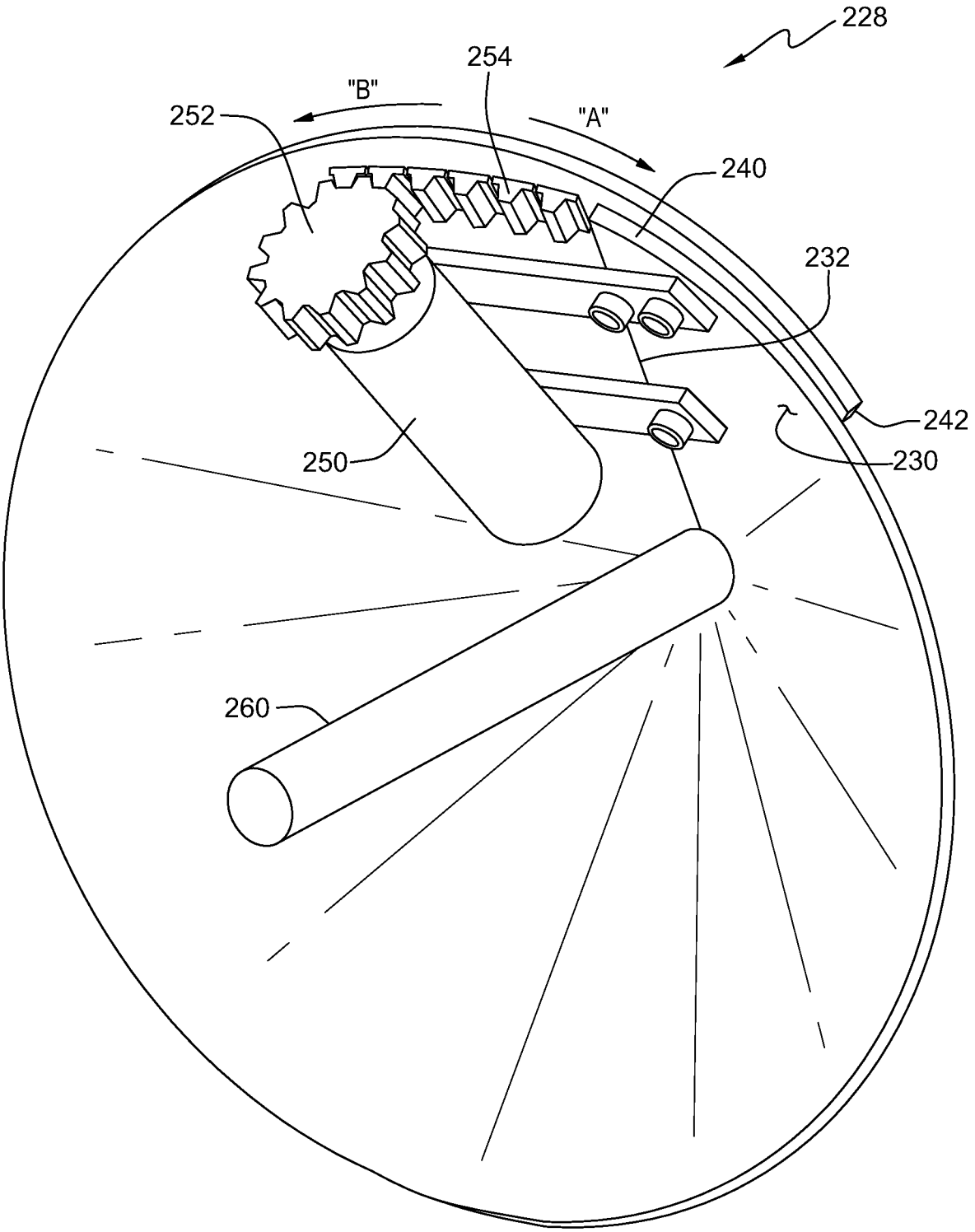
FIG. 5 depicts an inside view of a variable diameter cone according to an embodiment of the present invention.

FIG. 5 depicts an interior view of the cone 228. The cone 228 has a first overlapping portion 230 bounded by a first edge 232 (e.g. edge AC of FIG. 3). The first overlapping portion 230 is fixed and is the non-rotating part of the cone 228. The cone 228 has a second overlapping portion 240 bounded by a second edge 242 of the ductile material (e.g., edge AB).

The second overlapping portion 240 overlays the first overlapping portion 230 and is free to move. In order to vary the cone geometry, the first overlapping portion 230 and the second overlapping portion 240 are moved relative to each other. The second overlapping portion 240 is permitted to rotate in order to change the diameter of the cone 228.

A motor 250 is affixed to the first overlapping portion 230 with the motor causing a pinion gear 252 to rotate. A rack gear 254 is mounted to the second overlapping portion 240 with the pinion gear 252 is engaging the rack gear. Rotating the pinion gear 252 drives the rack gear 24 in either direction "A" or direction "B". As such, the motor 250 drives the rack and pinion assembly to cause relative motion between the first overlapping portion 230 and the second overlapping portion 240 with the result of varying the diameter of the cone 228.

Figure 6:
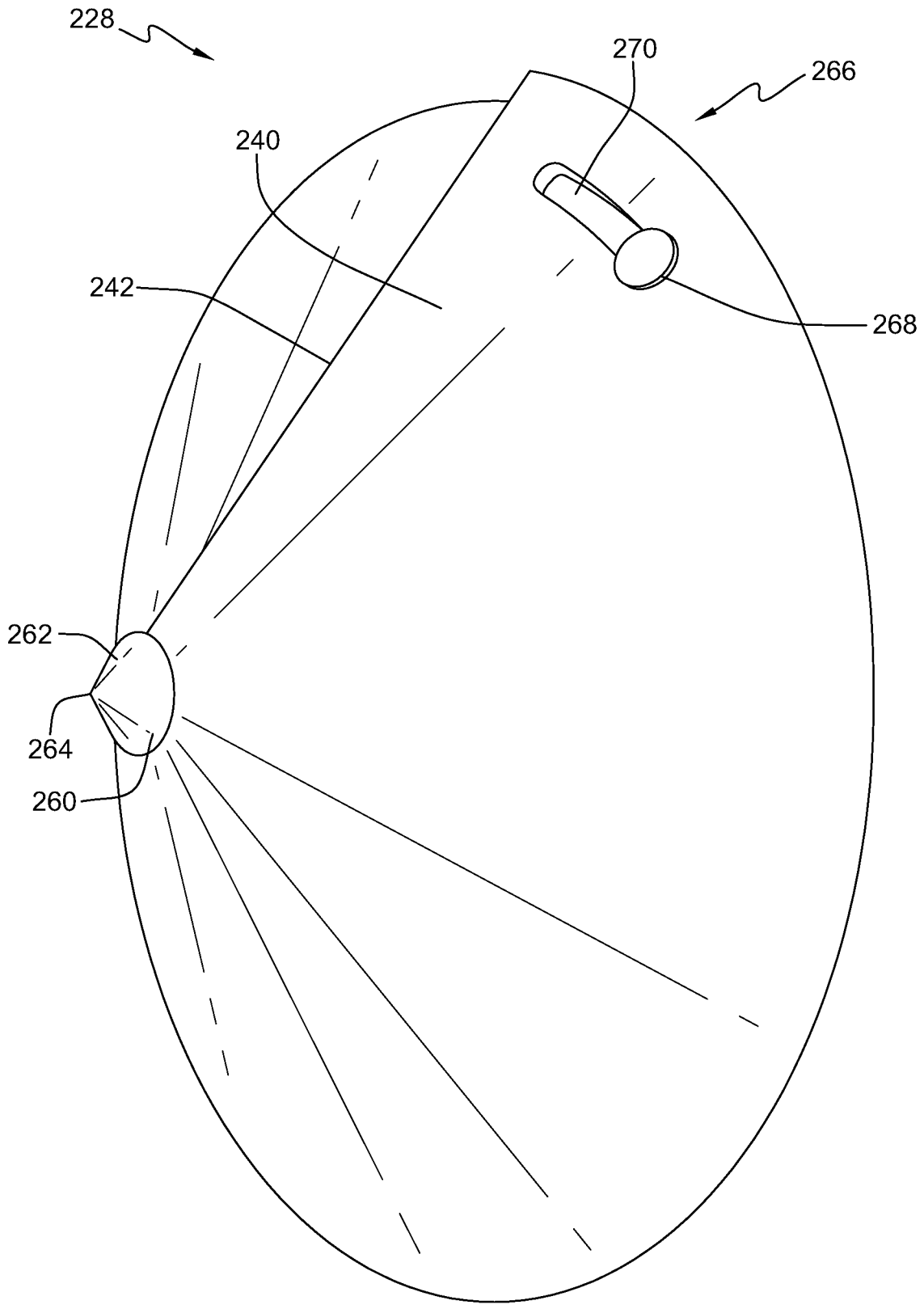
FIG. 6 depicts an outside view of the variable diameter cone of FIG. 5.

The cone 228 may have a support pole 260 that provides axial strength to the cone. As shown in FIG. 6, the support pole 260 has a conical tip 262 to form a peak 264 of the cone 228. A track and pin setup 266 can constrain the relative motion of the first overlapping portion 230 and the second overlapping portion 240. The track and pin setup 266 includes a pin 268 attached to the fixed first overlapping portion 230. The pin 268 is disposed in a track 270 cut in the second and moveable overlapping portion 240. The track and pin setup 266 maintains the shape of the cone 228 and can limit the maximum and minimum overlap $\theta$.

Figure 7:
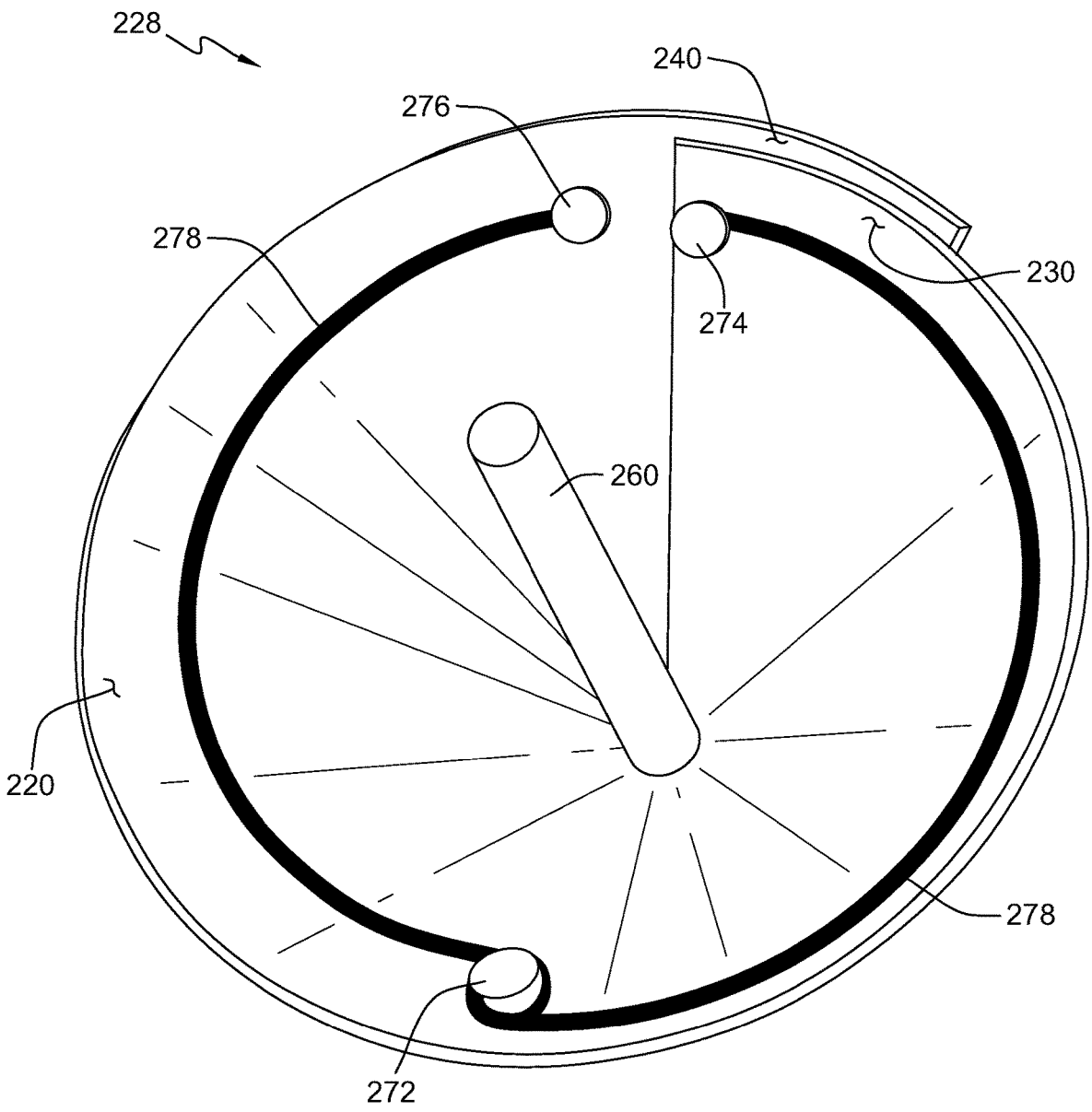
FIG. 7 depicts an inside view of a variable diameter cone of the present invention.

In FIG. 7, a capstan 272 drives the relative motion of the overlapping portions. A fixed pin 274 and a fixed pin 276 are provided on the first overlapping portion 230 and the second overlapping portion 240, respectively. The fixed pins 274, 276 connect to the capstan 272 by a wire or cable 278 with the cable is attached to the pins. When the capstan 272 rotates; the cable 278 winds to drive less overlap of the first overlapping portion 230 and the second overlapping portion 240 to open the cone 228 or to increase the base diameter of the cone. When the capstan 272 reverses direction or is released; the tension in the cable releases; thereby, lengthening the cable and allowing the cone 228 to close.

Alternatively, if the cable direction is re-routed from the capstan 272 to the fixed pins 274, 276; tensioning the cable will decrease the base diameter. By example, FIG. 7 can be used but with a wire from the capstan 272 (rotating the capstan to tension the cable) routed around the pin 276 as a pivot. Ultimately and attached to the pin 274; tensioning the cable at the capstan 274 to draw the pin 274 closer to the pin 276. The diameter of the cone 228 will decrease. This is effectivity the opposite of the depiction of FIG. 7 for an alternative use of the invention. Effectively, the right side of the cable 278 would not appear or be required.

Typically, a conical nose has a fixed geometry, which is adequate for some operating conditions but not for others.

The disclosed variable diameter cone 228 allows the geometry of the conical nose to be actively varied in situ, which allows for more optimal performance with respect to drag, lift, and cavity formation over a wide range of operating conditions.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A variable diameter conical nose comprising:

a cone having a first overlapping portion and a second overlapping portion overlying said first overlapping portion;

an actuator capable of varying the diameter of said cone by moving at least one of said first overlapping portion and said second overlapping portion relative to the other; and a rack and pinion assembly of a motorized pinion gear anchored to said first overlapping portion and a rack gear mounted to said second overlapping portion;

wherein said motorized pinion gear drives said rack gear to cause relative motion between said first overlapping portion and said second overlapping portion.

2. The conical nose in accordance with claim 1 wherein said actuator further comprises:

a capstan;

a first pin affixed to said first overlapping portion;

a second pin affixed to said second overlapping portion; and a cable wound around said capstan and connected to each of said first pin and said second pin;

wherein rotating said capstan winds said cable to cause relative motion between said first overlapping portion and said second overlapping portion by movement of said first pin and said second pin relative to each other.

3. The conical nose in accordance with claim 2 further comprising a support pole capable of providing axial strength to said cone.

4. The conical nose in accordance with claim 3, said support pole further comprising a conical tip forming a peak of said cone.

* * * * *